US005791530A

United States Patent [19]

Rabon

[11] Patent Number: 5,791,530

[45] Date of Patent: Aug. 11, 1998

[54] COVER SYSTEM FOR DUAL RAILCAR SPOUT OUTLETS

[76] Inventor: John Rabon, 22606 Bucktrout La., Katy, Tex. 77449

[21] Appl. No.: 906,422

[22] Filed: Aug. 5, 1997

[51] Int. Cl.[6] ..... B67D 3/00

[52] U.S. Cl. ..... 222/485; 222/556

[58] Field of Search ..... 222/129, 485, 222/556

[56] References Cited

U.S. PATENT DOCUMENTS

| | | | |
|---|---|---|---|
| 2,056,102 | 9/1936 | Henderson . | |
| 3,022,925 | 2/1962 | Daniell . | |
| 3,089,620 | 5/1963 | Green et al. . | |
| 3,391,837 | 7/1968 | Liebenthal | 222/485 |
| 3,469,747 | 9/1969 | Richmond, Jr. . | |
| 3,545,653 | 12/1970 | Blackmore . | |
| 3,656,666 | 4/1972 | Dugge et al. . | |
| 3,980,212 | 9/1976 | Aller et al. | 222/485 |

*Primary Examiner*—Philippe Derakshani
*Attorney, Agent, or Firm*—Richard C. Litman

[57] ABSTRACT

A railcar spout outlet cover system which prevents the unnecessary flow of granular product from a hopper with dual outlets when the shutoff valves are negligently or inadvertently left open. A lockable collar with a hinged cover is attached to each outlet. The covers have spring loaded, right-angled rods connected to a connecting rod, which permits simultaneous opening and automatic closing of the outlet covers.

3 Claims, 2 Drawing Sheets

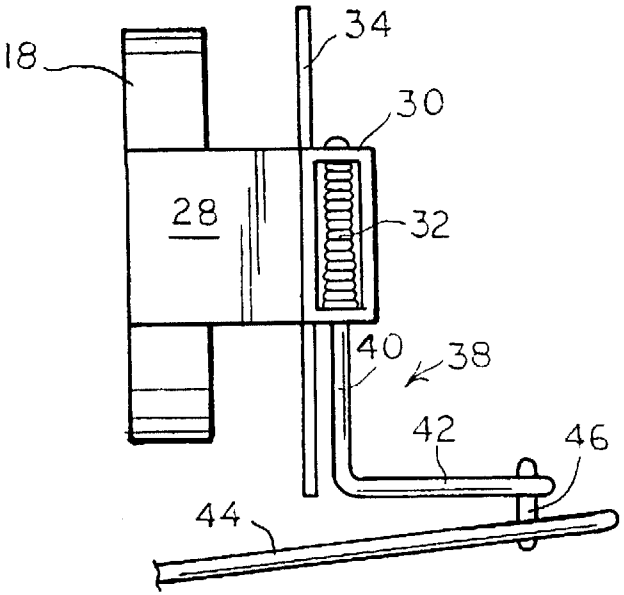
FIG. 3
FIG. 2
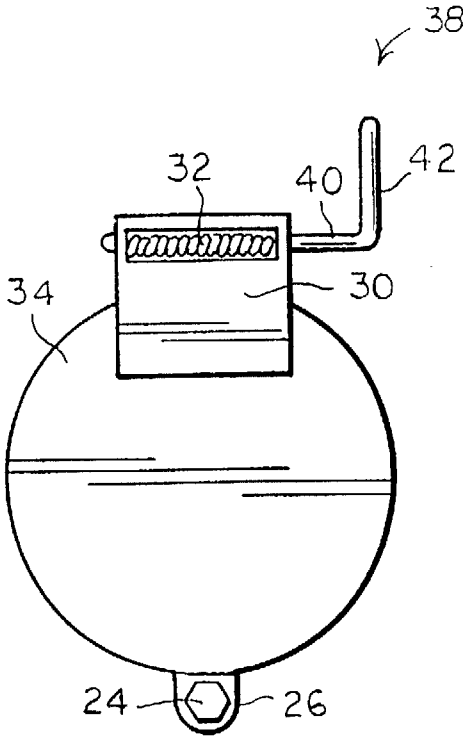

COVER SYSTEM FOR DUAL RAILCAR SPOUT OUTLETS

BACKGROUND OF THE INVENTION

1. Field of the Invention

The present invention relates to a cover system for simultaneously opening and closing dual covers for railcar hopper spout outlets, to prevent spillage of granular petrochemical products which would contaminate the environment when the main valve is negligently or inadvertently left open during transit.

2. Description of the Related Art

The related art describes various methods for closing a delivery chute or opening. The art of interest will be discussed in the order of their perceived relevance to the present invention.

U.S. Pat. No. 3,089,620 issued on May 14, 1963, to Martin Green et al. describes an apparatus for dispensing measured quantities of granular materials such as coffee, soap powder and corn meal from their packages by direct attachment of a pair of telescopically nested cylindrical pouring spout with an integrated triangular cutter situated on a 45° truncated bottom opening of the inside cylinder. The rubber flanged non-cylindrical measuring gate in the bottom opening has an outward positioned arrow. The bottom gate is opened by a lever inserted through the sides of the inner cylinder with a return spring. The outside cylinder has a hinged gate on top with a snap closure. The reference is distinguished by its simple top closure and its nonsynchronous gates.

U.S. Pat. No. 2,056,102 issued on Sep. 29, 1936, to Robert Henderson describes a dispensing container for soap powder and soap flakes consisting of a hopper inside a square casing. The hopper has two interacting gates operated by a spring-loaded shaft, an external handle and an internal wedge cam which locks the gates together for opening and starting the flow of material. The structure of this apparatus bears little resemblance to the present invention.

U.S. Pat. No. 3,022,925 issued on Feb. 27, 1962, to Frank P. Daniell describes a pouring spout cover with an external spring-loaded handle which pivots on a molded screw top closure element with a pouring spout for granular materials such as sugar. The pivoting cover has a disc underneath for sealing the spout when the cover is closed over the screw top closure element. The cover and closure element lack the structure of the present invention.

U.S. Pat. No. 3,656,666 issued on Apr. 18, 1972 to Richard H. Dugge et al. describes a releasable and pivoting lower cover for a hopper discharge outlet positioned beneath a butterfly valve. An elongate locking arm pivotally supports the lower cover. The arm has a lug at each end adapted to engage coacting lugs on the adjacent housing which supports the cover for pivotal movement between open and closed positions. The coacting lugs on the housing comprise cams for the arm and upon rotation of the arm in one direction after the coacting lugs are engaged for closing of the cover, the arm and cover are drawn tightly aginst the adjacent housing. Rotation of the arm in an opposite direction in an opposite direction releases the cover for pivotal movement to an open position. There is no suggestion for opening the cover in a vertical position as in the present invention.

U.S. Pat. No. 3,545,653 issued on Dec. 8, 1970, to Donald E. Blackmore describes a hopper having a rectangular side opening with a bottom valve housing for an arcuate valve element supported by a bracket and pivoting on a shaft connected to an external handle. This reference is distinguished by its structure and manual closing of the valve.

U.S. Pat. No. 3,469,747 issued on Sep. 30, 1969, to Roy H. Richmond, Jr. describes a storage can for flammable liquids with a spring-loaded handle and bell crank assembly to open and close the gas tank cap. This structure has little resemblance to the present invention.

None of the above inventions and patents, taken either singularly or in combination, is seen to describe the instant invention as claimed. Thus, dual covers for railcar spout outlets solving the aforementioned problems of spillage and protecting the environment is desired.

SUMMARY OF THE INVENTION

The present invention provides a railcar spout outlet cover system which controls the flow of granular product from a hopper with dual outlets. A lockable collar with a hinged cover is attached to each outlet. The covers have spring loaded right-angle rods connected to a connecting rod which permits simultaneous opening and automatic closing of the outlet covers.

The plastics producing petrochemical industry has been warned by the Environmental Protection Agency (EPA) to clean up all the plastic resin pellets that are spilled and left on the ground during transit by open hopper valves. The spilled pellets are being eaten by birds and small animals, causing their deaths. The EPA has warned that citations will be issued to the generators of the dangerous plastic pellets regardless of negligence or relative negligence between the customer, transporter and/or the manufacturer.

The present invention will ensure the elimination of spillage of hazardous cargo from hopper cars on the railroad track by the left open valves of the presumably empty railcars.

Accordingly, it is a principal object of the invention to provide a means for preventing granular petrochemical products spilling from railroad hopper cars and contaminating the environment.

It is another object of the invention to provide a cover system for railcars having dual hopper car outlet tubes.

It is a further object of the invention to provide a dual cover system for opening and closing both covers simultaneously.

Still another object of the invention is to provide a dual cover system with locking means for the covers during transit.

It is an object of the invention to provide improved elements and arrangements thereof in flapping covers for dual railcar spout outlets for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2 is an enlarged scale, elevational front view of one cover.

FIG. 3 is a plan view of the cover illustrated in FIG. 2.

Similar reference characters denote corresponding features consistently throughout the attached drawings.

DETAILED DESCRIPTION OF THE PREFERRED EMBODIMENT

Figure 1:
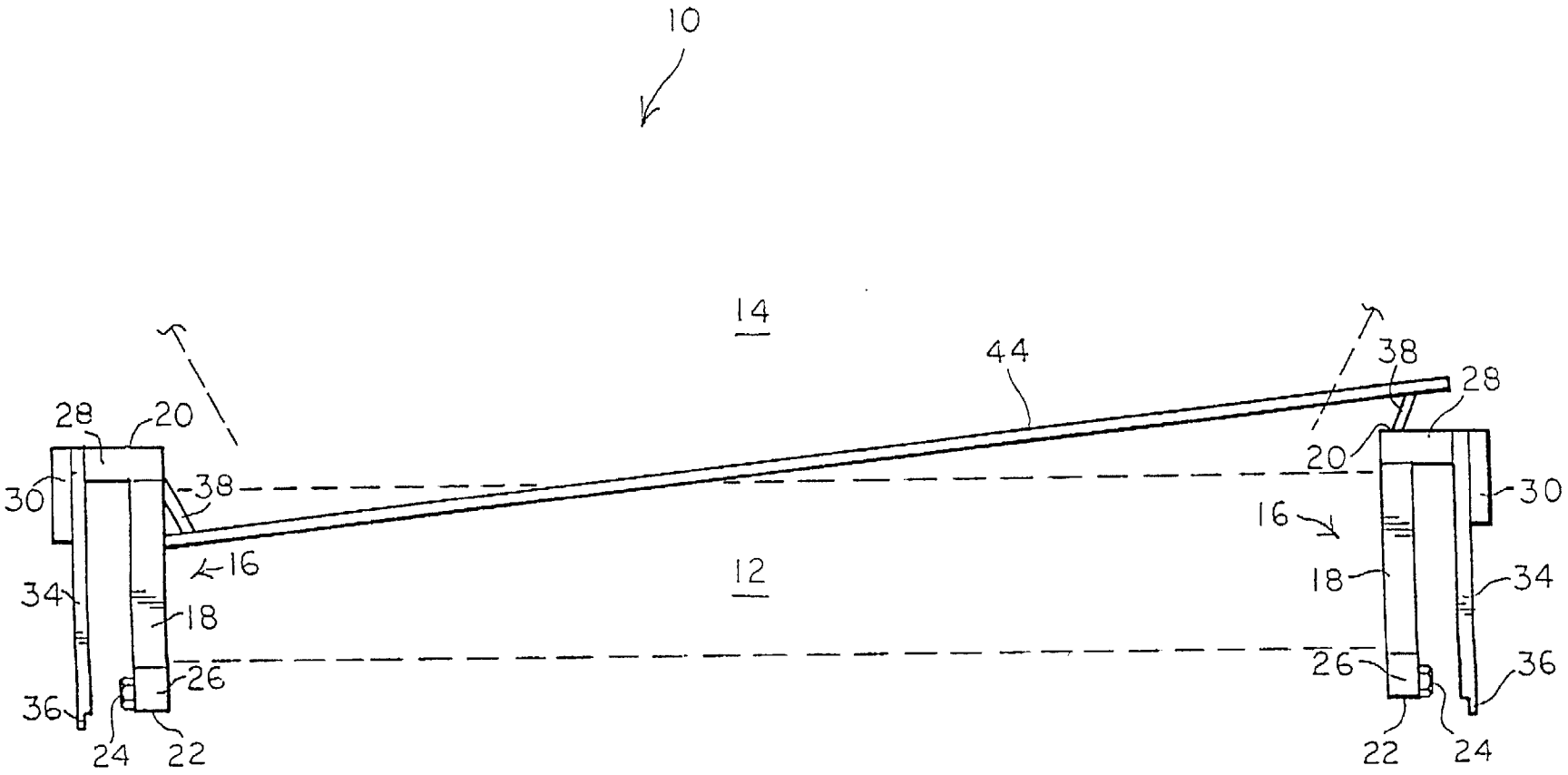
FIG. 1 is an elevational side view of the cover system for a railcar having dual spout outlets according to the present invention.

The present invention provides a means which eliminates the problem of environmental damage due to unnecessary spillage of contaminating petrochemical granules from a railcar hopper after emptying or partially emptying and during transit with the shut-off valve left open by negligence or inadvertence.

Railcar hoppers now have dual spout outlets with internal valves. However, a need exists for an automatic closure in the event the valves are left open during transit of a hopper car with residual environmentally dangerous cargo as explained above.

FIG. 1 is a side view of a closure system 10 with a dashed outline of the hopper outlet tube 12 and part of the hopper 14. At each outlet opening 16, a securable collar 18 having a curved top portion 20 and a curved bottom portion 22 adapted to fit the outlet opening 16 snugly is positioned with a fastener 24 on the tab 26.

Turning to the enlarged views of FIGS. 2 and 3 depicting the cover assembly, a substantially flat rectangular flange 28 attached to the curved top portion 20 of the collar 18 extends to and is further attached at its outer flat end to the hinge element 30 which contains a torsion spring 32. The hinge element 30 is integral with the top portion of circular cover 34. The torsion spring 32 has one end positioned underneath the flange 28 and its opposite end anchored inside the enclosure of the hinge element 30 (not shown). The cover 34 has a notch 36 for a finger hold.

A right-angled rod 38 has a first leg 40 encircled by the torsion spring 32 inside the hinge element 30 and a second leg 42 extending as a handle to pivot with a long straight connecting rod 44 via a pin 46. The connecting rod 44 thus connects each cover 34 in the same manner except as depicted in FIG. 1.

By this configuration, an operator can now open both covers 34 simultaneously and close both covers simultaneously and automatically upon release of the rod 38. Consequently, the manufacturer, the transporter, and the recipient of the environmentally hazardous pelleted product are absolved of any negligence charges by the EPA.

It is to be understood that the present invention is not limited to the embodiment described above, but encompasses any and all embodiments within the scope of the following claims.

I claim:

1. A closure system for dual railcar spout outlets comprising:

a pair of securable collars, each collar having a top portion and a bottom portion adapted for fitting a pair of circular outlet tubes of a railcar hopper;

a substantially flat rectangular flange extending out from the top portion of each collar and having an outer flat end;

a flat circular cover plate for each outlet tube having an area greater than the area of said outlet tube and hinged by a hinge element to the outer end of the flange;

said hinge element containing a torsion spring;

a right-angled rod with a first leg enclosed and connected to said torsion spring; and a straight connecting rod pivotally connected to a second leg of said right-angled rod;

whereby the cover plate prevents the spillage of environmentally hazardous cargo from the railcar hopper during transist by securely closing the spout outlet.

2. The closure system according to claim 1, wherein the connecting rod is connected to each second leg of each right-angled rod for the simultaneously opening and closing of each cover.

3. The closure system according to claim 1, wherein a lower portion of the collar is fastened to each spout outlet.

* * * * *